US007892149B2

(12) United States Patent
Wu

(10) Patent No.: US 7,892,149 B2
(45) Date of Patent: Feb. 22, 2011

(54) FOLDING STRUCTURE OF A TREADMILL

(75) Inventor: Shen-Yi Wu, Taichung (TW)

(73) Assignee: Strength Master Fitness Tech Co., Ltd., Taichung (TW)

( * ) Notice: Subject to any disclaimer, the term of this patent is extended or adjusted under 35 U.S.C. 154(b) by 0 days.

(21) Appl. No.: 12/382,451

(22) Filed: Mar. 17, 2009

(65) Prior Publication Data

US 2010/0240497 A1 Sep. 23, 2010

(51) Int. Cl.
*A63B 22/02* (2006.01)

(52) U.S. Cl. ..... 482/54

(58) Field of Classification Search ..... 482/54, 482/42, 51, 52; 280/87.05
See application file for complete search history.

(56) References Cited

U.S. PATENT DOCUMENTS 2,282,086 A * 5/1942 Peltier ..... 280/87.05
5,679,101 A * 10/1997 Magid ..... 482/54
5,803,874 A * 9/1998 Wilkinson ..... 482/54
D500,348 S * 12/2004 Parise ..... D21/669
2007/0015634 A1* 1/2007 Ho et al. ..... 482/54
2009/0181830 A1* 7/2009 Wu ..... 482/54

* cited by examiner

*Primary Examiner*—Loan Thanh
*Assistant Examiner*—Shila Abyaneh
(74) *Attorney, Agent, or Firm*—Rosenberg, Klein & Lee

(57) ABSTRACT

A folding structure of a treadmill includes a base with a treadmill belt, two support frames pivotally coupled to a front end of the base, a fixture installed a pivotally connection position of the two support frames and the base, the front sections of the two lateral bars being pivotally and respectively coupled onto the two support frames, a support bar being pivotally coupled to a rear section of each lateral bar, and the support bar being pivotally coupled to a rear end of the base, such that the lateral bars are supported by the support frame and the support bar to form a transversally extended holding section.

5 Claims, 10 Drawing Sheets

FOLDING STRUCTURE OF A TREADMILL

BACKGROUND OF THE INVENTION

1. Field of the Invention

The present invention relates to a folding structure of a treadmill, and more particularly to a folding structure of a treadmill.

2. Description of the Related Art

With reference to FIGS. 9 and 10 for a conventional folding treadmill 1, the folding treadmill is lifted towards a support frame 3 by using a front end of a treadmill platform 2 as an axis, such that the treadmill platform 2 can be erected and folded in order to reduce the footprint of the treadmill 1. However, the volume of the folded treadmill is still relatively large and inconvenient for its transportation and storage.

To reduce the volume of the folding treadmill 1 after the treadmill 1 is folded, manufacturers generally design a handrail 4 with an appropriate length on the support frame 3, such that the length of the handrail 4 only allows users to stretch their hands towards the support frame 3 to hold the handrail 4. In other words, the holding positions of the user's hands are limited for more diversified fitness exercises.

Therefore, it is an important subject of the invention to provide an improved folding structure of a treadmill to overcome the shortcomings of the prior art.

SUMMARY OF THE INVENTION

In view of the shortcomings of the prior art, the inventor of the invention based on years of experience in the related industry to conduct extensive researches and experiments, and finally developed a folding structure of a treadmill in accordance with the present invention.

The primary objective of the present invention is to provide a folding structure of a treadmill, wherein a lateral bar with a longer length is disposed individually on both sides of the treadmill and provided for users to have more diversified fitness exercises, and the lateral bars can be folded onto the base of the treadmill, and thus the invention can reduce the overall volume of the folded treadmill effectively.

To achieve the foregoing objective, the present invention provides a folding structure of a treadmill, comprising:

a base, having a treadmill belt, a front end and a rear end, and two support frames pivotally and correspondingly coupled to and extended upwardly from the front end of the base, and each of the two support frames having a first end and a second end disposed on an opposite side of the first end, and the first end of each support frame being pivotally coupled to the base, and having a fixture installed at a pivotally connecting position of the two support frames and the base for fixing the support frame; and two lateral bars, each having a front section and a rear section, and the front section of each lateral bar being pivotally coupled to the second end of the two support frames, and a support bar pivotally coupled to the rear section of the two lateral bars, and each support bar being coupled to the rear end of the base which is situated on an opposite side of each lateral bar, and the lateral bar being supported by the support frame and the support bar to form a transversally extended holding section.

If the fixture is released from a fixed state with the support frame, the two support frames are pivotally swung to the front side of the base to drive the lateral bar and the support bar to pivotally swing to a folding position, and then the two support frames are pivotally swung to the rear side of the base, such that each lateral bar is turned to the rear by using the pivotally connecting position of each support bar as a turning center to fold each lateral bar onto each support bar, and each lateral bar and the support bar can be folded together with the two support frames onto the base.

Further, each lateral bar is in a hollow tubular shape, and an extension bar is sheathed and coupled to each lateral bar, such that the extension bar can be slid or moved in the lateral bar to increase the length of the lateral bar. Each extension bar further includes a wheel coupled to and exposed from an end of the lateral bar.

Other features and advantages of the present invention will become apparent in the following detailed description of the preferred embodiments with reference to the accompanying drawings.

DETAILED DESCRIPTION OF THE PREFERRED EMBODIMENTS

Figure 1:
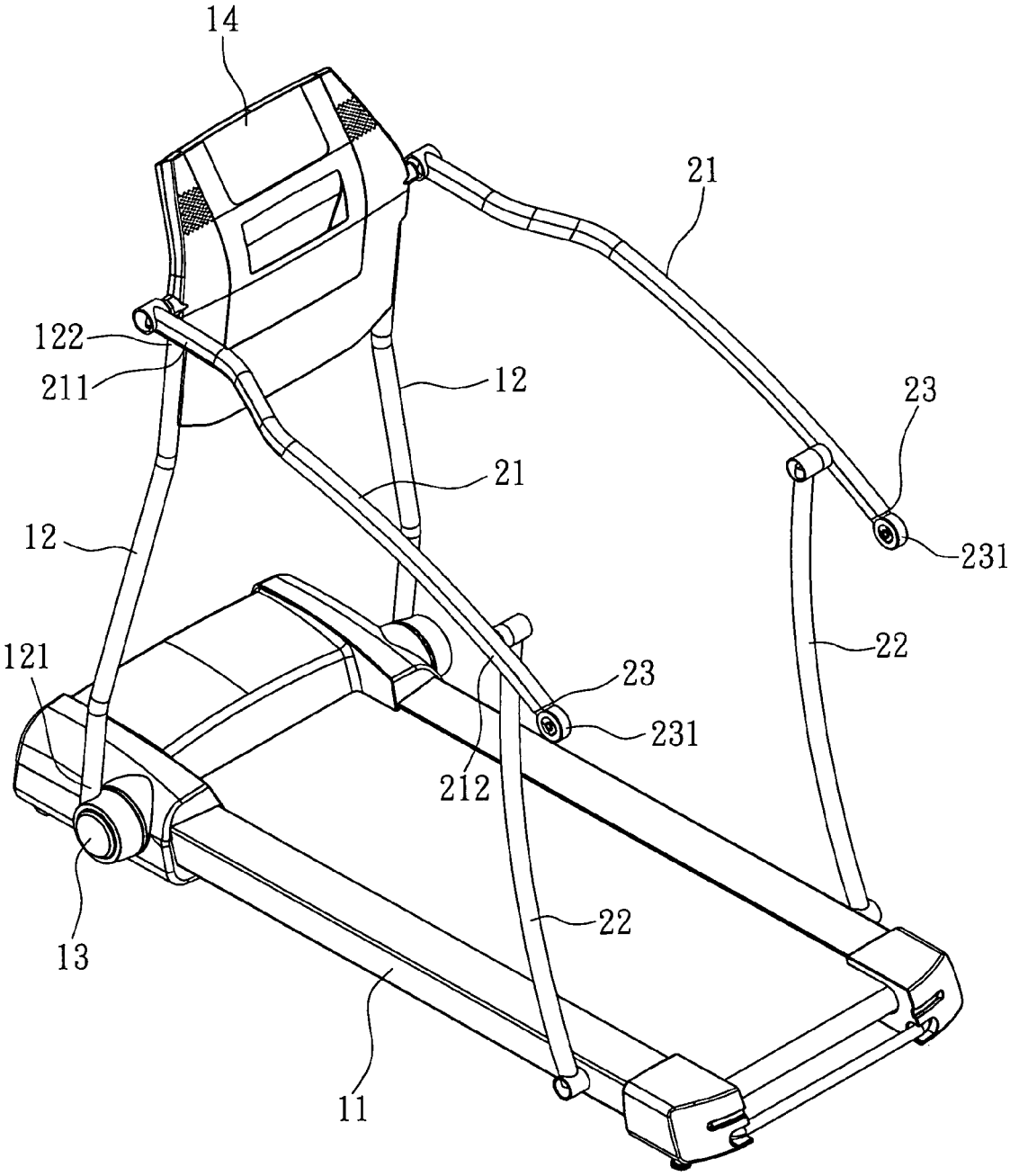
FIG. 1 is a perspective view of a preferred embodiment of the present invention.
Figure 2:
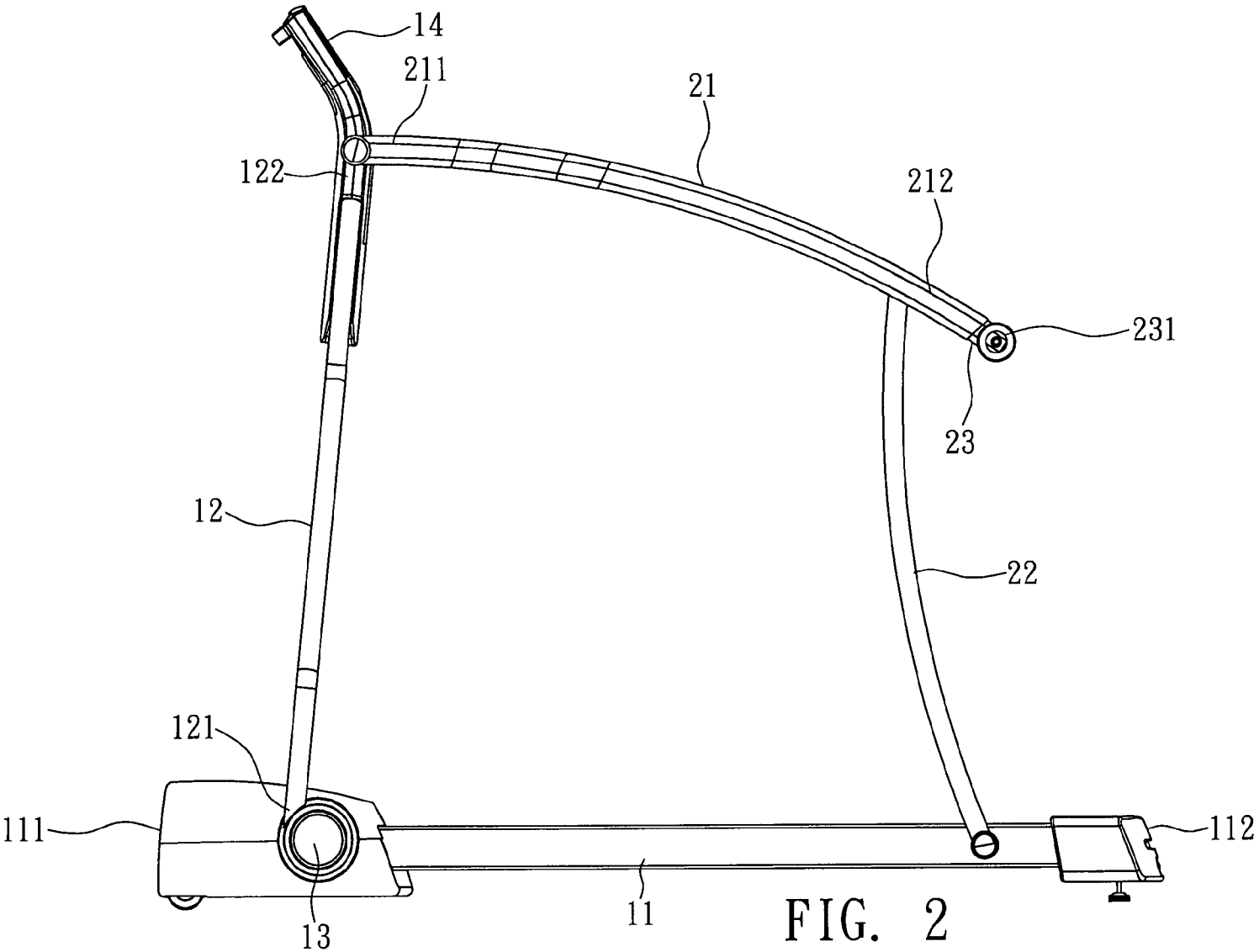
FIG. 2 of an application of a treadmill in accordance with a preferred embodiment of the present invention, showing a general application of the treadmill.

In FIGS. 1 and 2, the present invention provides a folding structure of a treadmill, comprising the following elements:

A base 11 includes a treadmill belt, and the base has a front end 111 and a rear end 112, and two upwardly extended support frames 12 are respectively disposed on both sides of the base 11 and pivotally coupled at the front end 111 of the base 11, and each support frame 12 has a first end 121 and a second end 122 disposed on an opposite side of the first end 121, and the first end 121 of each support frame 12 is pivotally coupled to a lateral side of the front end of the base 11, and a fixture 13 is disposed at a pivotally connecting position of the two support frames 12 and the base 11 for fixing the support frame 12, and a control panel 14 is installed between the second ends 122 of the two support frames 12.

Each of two lateral bars 21 has a front section 211 and a rear section 212, and the front section 211 of each lateral bar 21 is pivotally coupled to the second end 122 of the two support frames 12, and a support bar 22 is pivotally coupled to the rear section 212 of the two lateral bars 21, and another end of the each support bar 22 on an opposite side of each lateral bar 21 is pivotally coupled to a lateral side of the rear end 112 of the base 11, and the lateral bar 21 is supported by the support frame 12 and the support bar 22 to form a transversally extended holding section, and each lateral bar 21 is in a hollow tubular shape, and an extension bar 23 is sheathed and coupled to each lateral bar 21, such that the extension bar 23 can be slid or moved in the lateral bar 21 for increasing the length of the lateral bar 21, and a wheel 231 is installed at the extension bar 23 and exposed from an end of the lateral bar 21.

In the treadmill composed of the aforementioned components, the two lateral bars 21 have a larger length, and thus users can hold the lateral bars 21 on both sides with their hands easily to achieve a slow walking effect for physical therapy when the treadmill belt of the treadmill is adjusted to a slower operating speed. Thus, the present can provide users more diversified applications.

Figure 3:
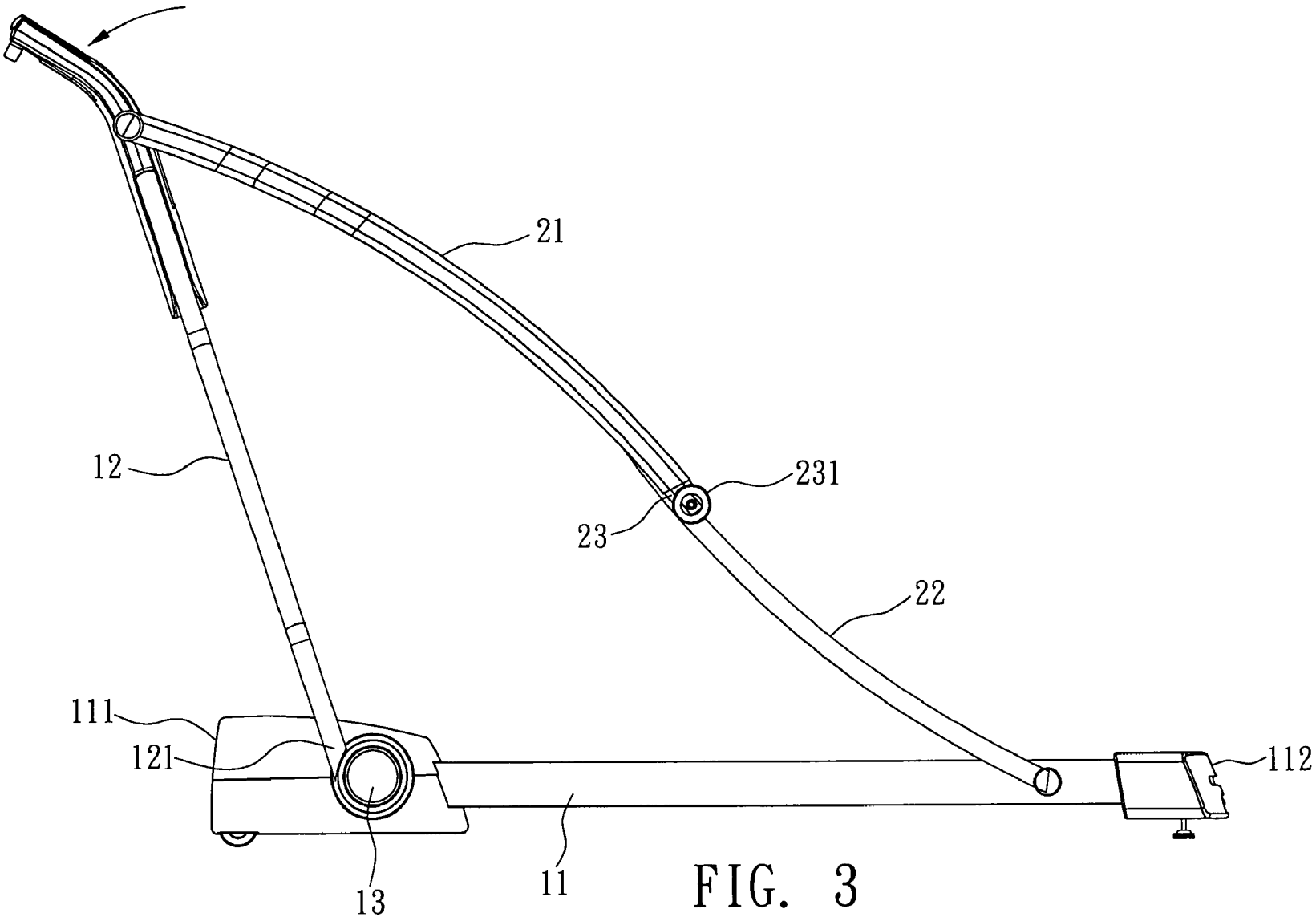
FIG. 3 is a schematic view of an application of a treadmill in accordance with a preferred embodiment of the present invention, showing a status of a support frame being pivotally swung in a direction towards the front side of the base to synchronously drive a lateral bar and a support bar to pivotally swing to a folding position, when the fixture is released from a fixed state of the support frame.
Figure 4:
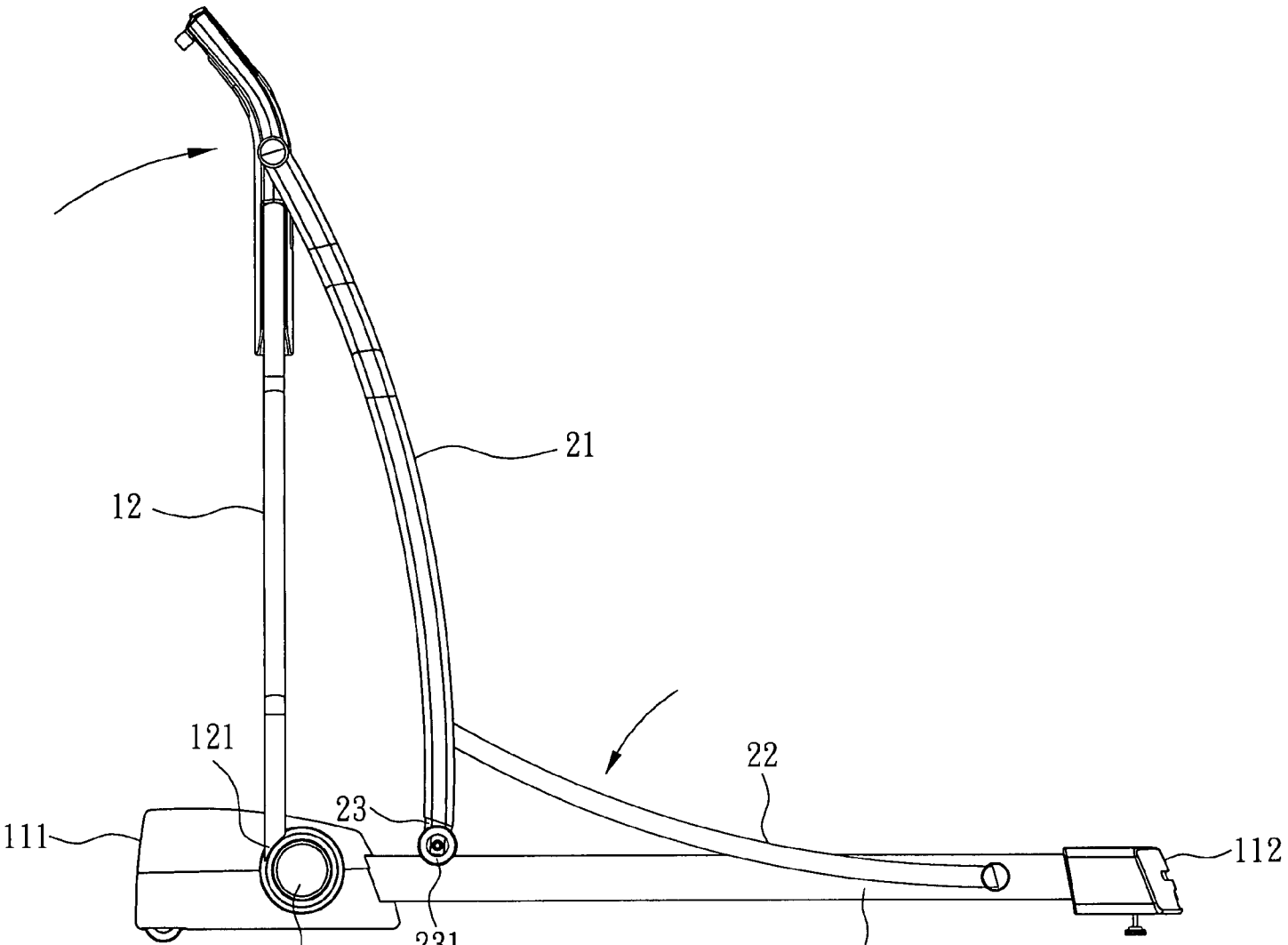
FIG. 4 is a schematic view of an application of a treadmill in accordance with a preferred embodiment of the present invention, showing a status of forcing a support bar to swing towards a base for folding the treadmill, when a lateral bar is turned to the rear side by using the pivotally connecting position of the support bar as a turning center.
Figure 5:
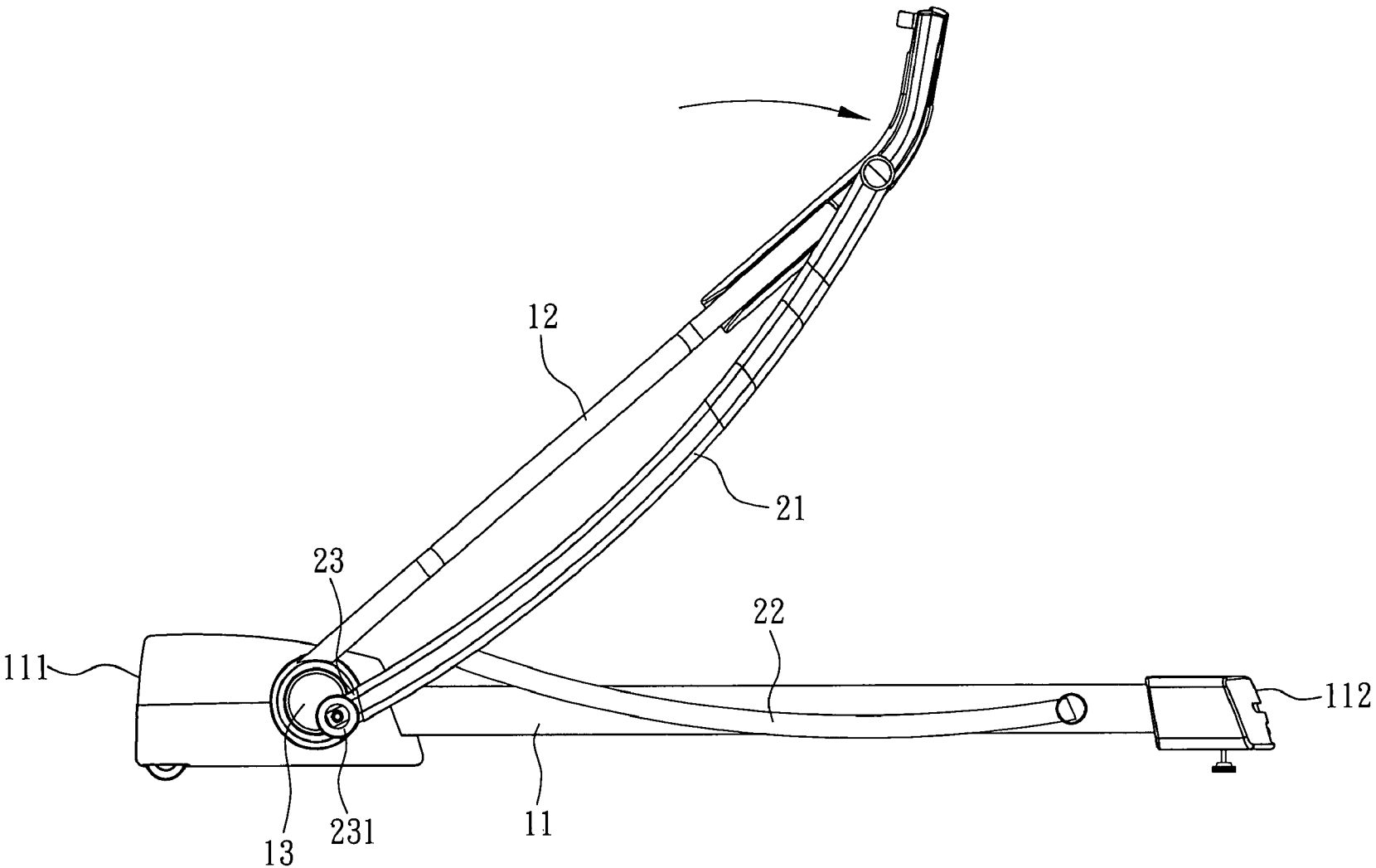
FIG. 5 is a schematic view of an application of a treadmill in accordance with a preferred embodiment of the present invention, showing a status of lateral bar being turned in an opposite direction and disposed on a support bar, when a support frame is continuously and pivotally swung towards the rear side of a base.
Figure 6:
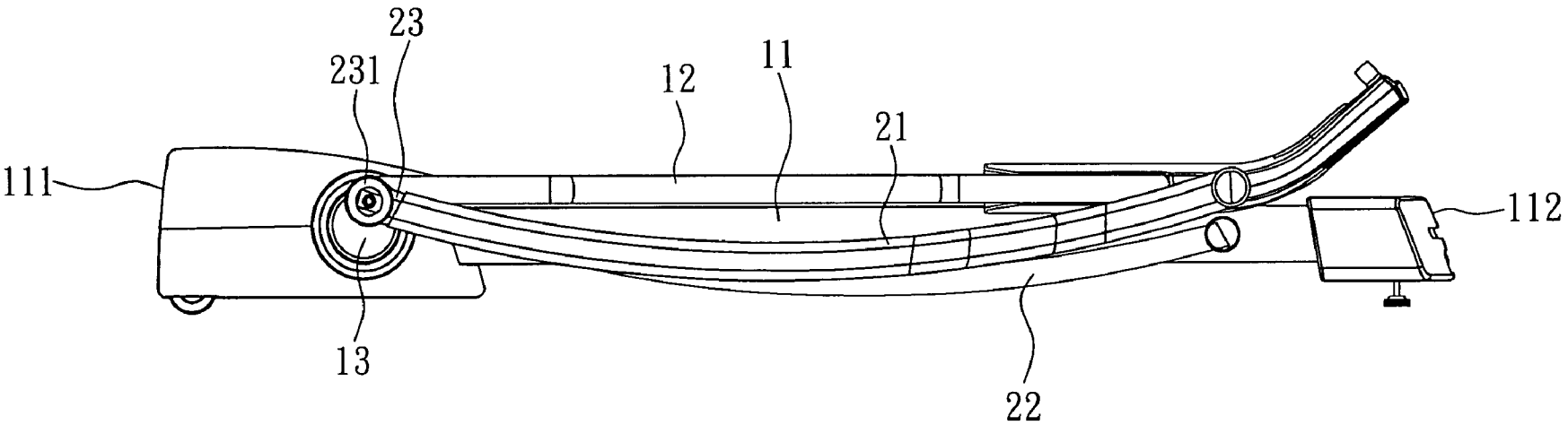
FIG. 6 is a schematic view of an application of a treadmill in accordance with a preferred embodiment of the present invention, showing a status of a lateral bar and a support bar treadmill being folded together with a support frame onto the base.

If it is necessary to fold the treadmill of the invention, users simply release the fixed state of the fixture 13 from the support frame 12, wherein the fixed state of the support frame 12 with the base 11 is determined by the tightness of securing or loosening the fixture 13. Since the fixture 13 is not the key point of the present invention, its detailed structure will not be described here. If the fixed state of the fixture 13 is released from the support frame 12 as shown in FIG. 3, the users can swing the two support frames 12 pivotally towards the front side of the base 11 and synchronously drive the lateral bar 21 and the support bar 22 to be swung pivotally to a folding position. Now, the lateral bar 21 and the support bar 22 are driven by the support frame 12 to pivotally swing with an angle of inclination tilted towards the front side of the base 11. In FIG. 4, the users simply need to swing the two support frames 12 pivotally towards the front of the base 11 to turn in an opposite direction by using the pivotally connecting position of each lateral bar 21 and each support bar 22 as a turning center and force the support bar 22 to be folded pivotally towards the base 11. The two support frames 12 are swung pivotally towards the rear side of the base 11 as shown in FIGS. 5 and 6, and each lateral bar 21 can be turned and folded onto each support bar 22, such that each lateral bar 21 and the support bar 22 can be folded together with the two support frames 12 onto the base 11 to complete folding the treadmill of the present invention.

With the aforementioned folding method, the treadmill of the present invention can be folded flatly, and the lateral bar 21 and the support bar 22 can be folded together with the two support frames 12 onto the base 11 to assure that the volume of the folded treadmill remains the same, so as to facilitate the storage of the folded treadmill under a bed or a sofa and achieve the effect of maximizing the utility of space at home.

Figure 7:
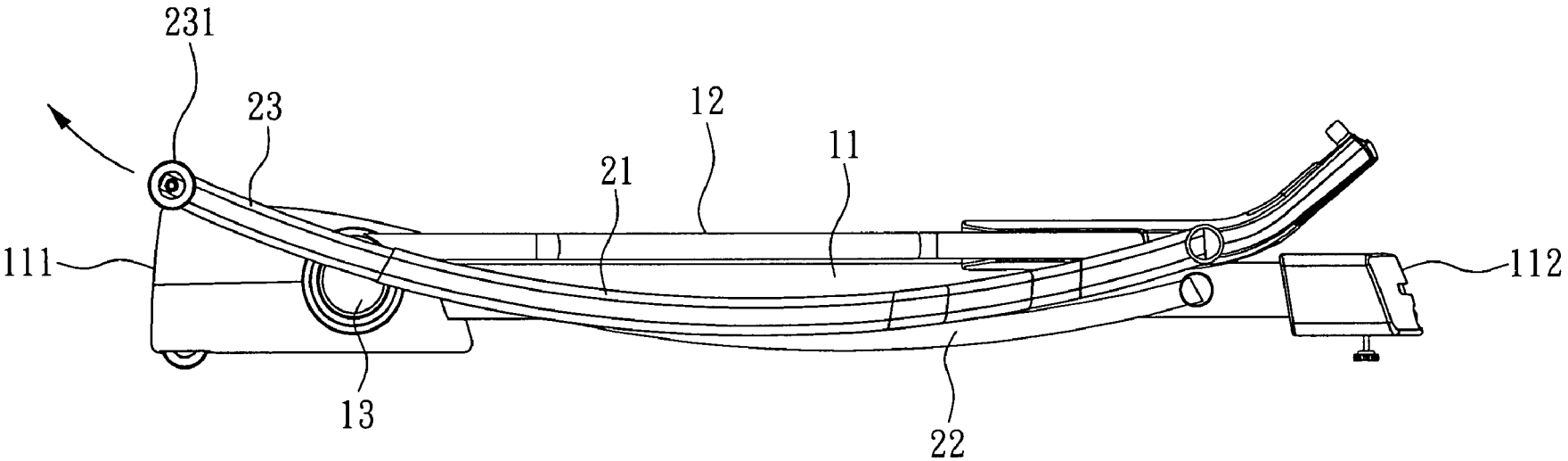
FIG. 7 is a schematic view of an application of a treadmill in accordance with a preferred embodiment of the present invention, showing a status of the treadmill being folded flatly, and an extension bar being pulled out from a lateral bar.
Figure 8:
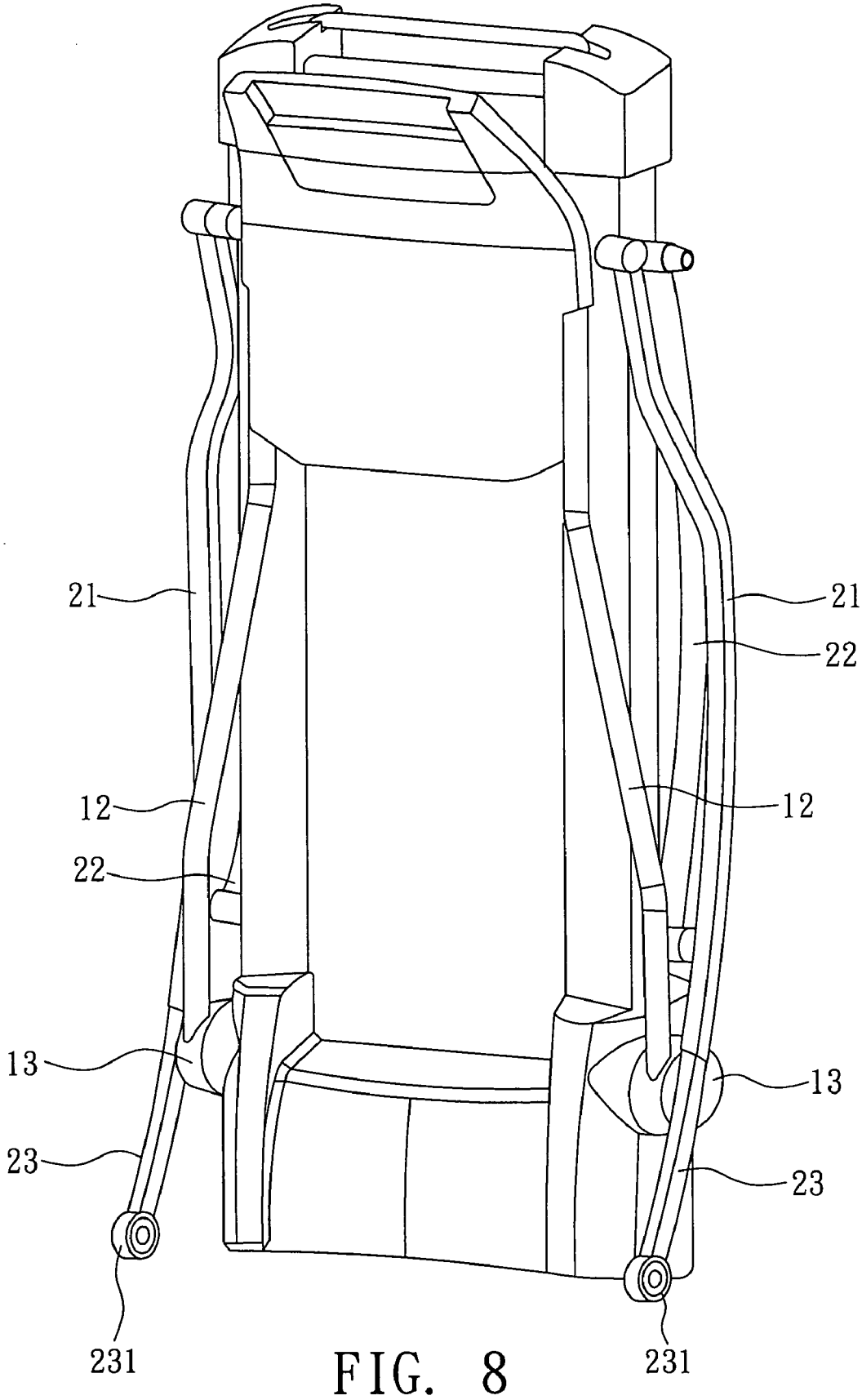
FIG. 8 is a schematic view of an application of a treadmill in accordance with a preferred embodiment of the present invention, showing a status of the treadmill being erected and stored.
Figure 9:
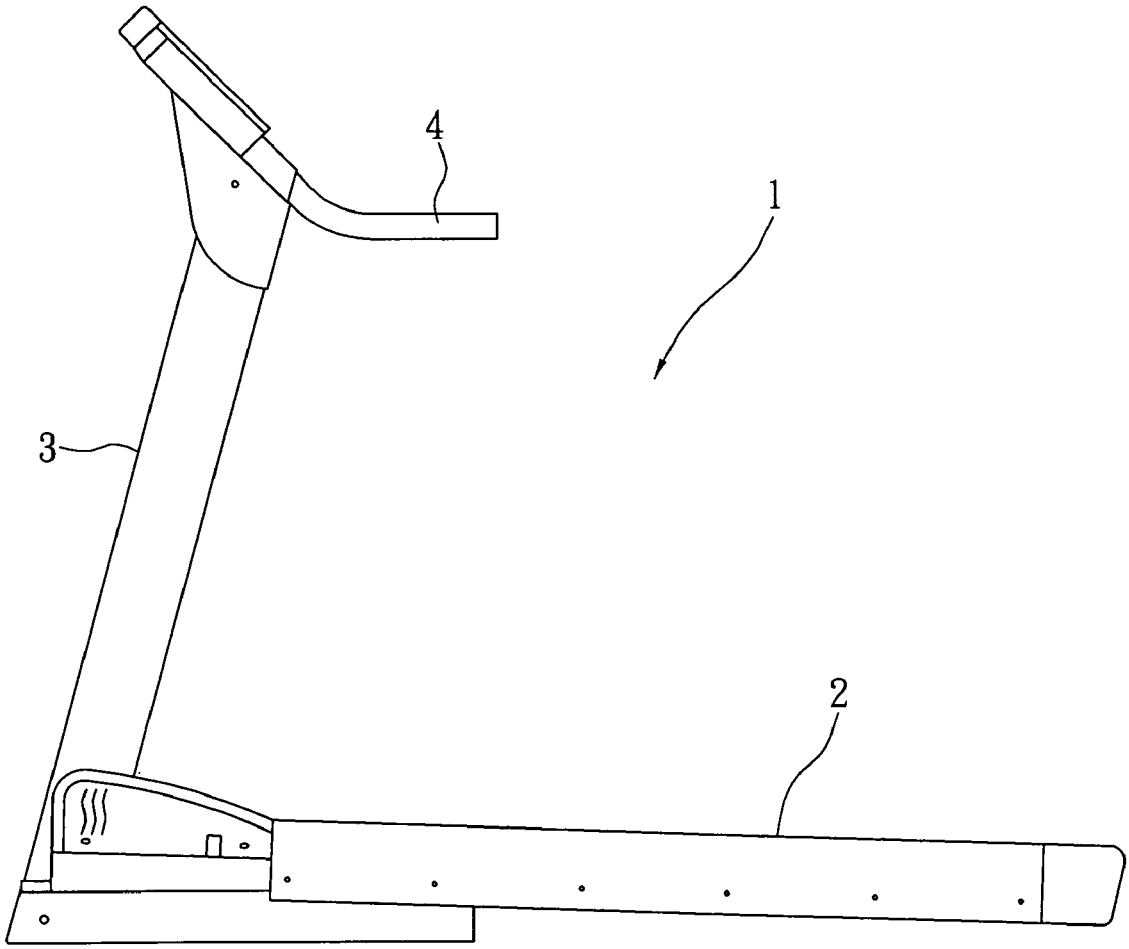
FIG. 9 PRIOR ART
FIG. 9 is a schematic view of a structure of a conventional folding treadmill before the treadmill is folded.
Figure 10:
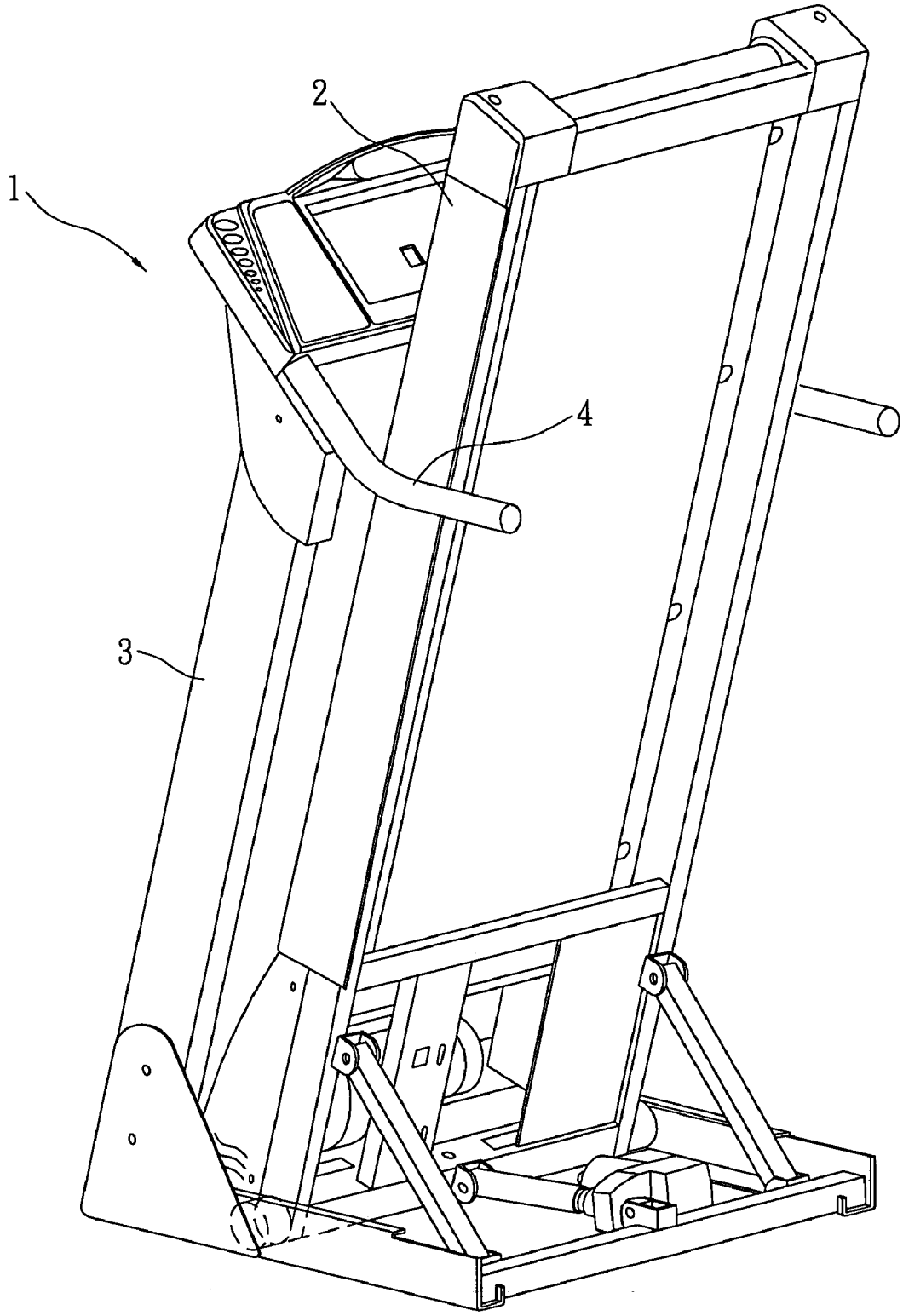
FIG. 10 PRIOR ART
FIG. 10 is a schematic view of a structure of a conventional folding treadmill after the treadmill is folded.

In FIG. 7, users simply need to pull the extension bar 23 of each lateral bar 21 out from the lateral bar 21 to fix the folded structure, if the folding structure of the present invention is situated at a flatly folded state. In FIG. 8, each extension bar 23 can provide a support point for the erected and folded treadmill, so that the folding structure of the invention can be erected and stored. Since the wheel 231 is installed at the extension bar 23 and exposed from a distal end of the lateral bar 21, such arrangement facilitates the transportation of the treadmill.

While the invention has been described by means of specific embodiments, numerous modifications and variations could be made thereto by those skilled in the art without departing from the scope and spirit of the invention set forth in the claims.

What is claimed is:

1. A folding structure of a treadmill, comprising:

a base, having a treadmill belt, a front end and a rear end, and two support frames pivotally and correspondingly coupled to and extended upwardly from the front end of said base, and each of said two support frames having a first end and a second end disposed at an opposite position of said first end, and the first end of each said support frame being pivotally coupled to said base, and having at least one fixture located on either side of said base, said first end of said support frame respectively being pivotally coupled to said fixture for fixing said support frame to said front end of said base, said fixture determining the fixed state of said support frame with said base by either tightening or loosening said fixture;

two lateral bars, each having a front section and a rear section, and the front section of each said lateral bar being pivotally coupled to the second end of a corresponding one of said two support frames;

a pair of support bars respectively pivotally coupled to the rear section of said two lateral bars, each said support bar being coupled to the rear end of said base which is on an opposite side of each said lateral bar, and each said lateral bar being supported by said support frame and said support bar to form a transversally extended holding section; and a control panel installed between the second ends of said two support frames; and wherein said two support frames are pivotally swung to drive said lateral bars and said support bars to be pivotally swung to a folding position and said support bars can be folded together with said two support frames onto said base.

2. The folding structure of a treadmill of claim 1, wherein each said lateral bar is in a hollow tubular shape, and an extension bar is respectively sheathed and coupled to each said lateral bar, such that said extension bars can be slid or moved in said lateral bars.

3. The folding structure of a treadmill of claim 2, wherein each said extension bar includes a wheel coupled to and exposed from an end of said lateral bar.

4. The folding structure of a treadmill of claim 1, wherein said two support frames are pivotally swung to the front end of said base and said two support frames are pivotally swung to the rear end of said base, if said fixture is released from a fixed state of said support frame, such that each said lateral bar is turned to the rear by using the pivotally connecting position of each said support bar as a turning center to fold each said lateral bar adjacent to each support bar, and each said lateral bar can be folded together with said two support frames onto said base.

5. A folding structure of a treadmill, comprising:

a base, having a treadmill belt, a front end and a rear end, and two support frames pivotally and correspondingly coupled to and extended upwardly from the front end of said base, and each of said two support frames having a first end and a second end disposed at an opposite position of said first end, and the first end of each said support frame being pivotally coupled to said base, and having at least one fixture located on either side of said base, said first end of said support frame respectively being pivotally coupled to said fixture for fixing said support frame to said front end of said base, said fixture determining the fixed state of said support frame with said base by either tightening or loosening said fixture;

two lateral bars, each having a front section and a rear section, and the front section of each said lateral bar being pivotally coupled to the second end of a corresponding one of said two support frames, each said lateral bar being in a hollow tubular shape, and an extension bar being respectively sheathed and coupled to each said lateral bar, such that said extension bars can be slid or moved in said lateral bars; and a pair of support bars respectively pivotally coupled to the rear section of said two lateral bars, each said support bar being coupled to the rear end of said base which is on an opposite side of each said lateral bar, and each said lateral bar being supported by said support frame and said support bar to form a transversally extended holding section; and wherein said two support frames are pivotally swung to drive said lateral bars and said support bars to be pivotally swung to a folding position and said support bars can be folded together with said two support frames onto said base.

* * * * *